US008838304B2

(12) United States Patent
Xu et al.

(10) Patent No.: US 8,838,304 B2
(45) **Date of Patent: *Sep. 16, 2014**

(54) METHOD FOR DETERMINING RUN-CURVES FOR VEHICLES BASED ON TRAVEL TIME

(75) Inventors: Jingyang Xu, Malden, MA (US); Daniel Nikovski, Brookline, MA (US)

(73) Assignee: Mitsubishi Electric Research Laboratories, Inc, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/538,794

(22) Filed: Jun. 29, 2012

(65) Prior Publication Data

US 2014/0005876 A1 Jan. 2, 2014

(51) Int. Cl.
*B61L 27/04* (2006.01)

(52) U.S. Cl.
USPC ..... 701/20; 701/19; 246/182 R

(58) Field of Classification Search
USPC ..... 701/19–20, 99
See application file for complete search history.

(56) References Cited

U.S. PATENT DOCUMENTS

| | | | | |
|---|---|---|---|---|
| 5,627,752 | A * | 5/1997 | Buck et al. | 701/36 |
| 5,828,979 | A | 10/1998 | Polivka et al. | |
| 2004/0059475 | A1* | 3/2004 | Hawthorne | 701/19 |
| 2007/0219681 | A1* | 9/2007 | Kumar et al. | 701/19 |
| 2007/0219683 | A1* | 9/2007 | Daum et al. | 701/19 |
| 2010/0174440 | A1* | 7/2010 | Franchineau et al. | 701/29 |
| 2010/0262321 | A1* | 10/2010 | Daum et al. | 701/20 |
| 2012/0277940 | A1* | 11/2012 | Kumar et al. | 701/20 |
| 2012/0323412 | A1* | 12/2012 | Chandra et al. | 701/19 |
| 2013/0151107 | A1* | 6/2013 | Nikovski et al. | 701/99 |

FOREIGN PATENT DOCUMENTS

| | | | |
|---|---|---|---|
| DE | 4344369 | A1 | 7/1995 |
| WO | 2009064966 | A1 | 5/2009 |

OTHER PUBLICATIONS

H. Ko et al. "Application of Dynamic Programming to Optimization of Running Profile of a Train;" Sophia University, Japan.

Ding Yong et al. "A Two-Level Optimization Model and Algorithm for Energy-Efficient Urban Train Operation;" Journal of Transportation Systems Engineering and Information Technology; vol. 11, Issue 1, Feb. 2011; pp. 99-101.

K.K. Wong et al. "Coast Control for Mass Rapid Transit Railways with Searching Methods," IEE Proc-Electr. Power Appl., vol. 151, No. 3, May 2004.

Li Lang et al. "An Optimal Driving Strategy for High-Speed Electric Train," Proceeding of the 30th Chinese Control Conference, Jul. 22-24, 2011, Yantai China; pp. 5899-5904.

* cited by examiner

*Primary Examiner* — Khoi Tran
*Assistant Examiner* — Ryan Rink
(74) *Attorney, Agent, or Firm* — Dirk Brinkman; Gene Vinokur

(57) ABSTRACT

A method reduces the computation time for determining optimal run-curves for a specific travel time of a vehicle along a route between two locations. The computation is partitioned between pre-processing and real-time steps. A set of weights μ are generated, and run-curves for the weights are obtained and stored during the pre-processing. State transition matrices can also be determined and stored during the pre-processing. During real-time, a specific travel time is obtained. The travel time is used to interpolate the weight μ for the specific travel time from the stored weights. The memory can be updated for each solution for a specific travel time to dramatically reduce the time to optimize the run-curves.

10 Claims, 3 Drawing Sheets

METHOD FOR DETERMINING RUN-CURVES FOR VEHICLES BASED ON TRAVEL TIME

RELATED APPLICATION

This application is related to U.S. patent application Ser. No. 13/324,075, "Method for Optimizing Run Curve of Vehicles," filed by Nikovski et al., on Dec. 13, 2011, incorporated herein by reference in its entirety. Both applications deal with the same technical areas related to determining optimal run curves for vehicles.

FIELD OF THE INVENTION

This invention relates generally to run-curve optimization for vehicles, and more particularly to optimizing run curves for vehicles to satisfy a travel time requirement while minimizing energy consumption by the vehicles.

BACKGROUND OF THE INVENTION

In a railroad system, especially a high-density railway system such as a subway system, vehicles in a train run along a route according to a schedule that can have different travel times that arise from an overall schedule for the high-density railway system. For the travel times, it is necessary to determine an optimal velocity profile for the train, such that energy consumption is minimized, while simultaneously satisfying all constraints of motion, such as velocity limits, safety zones, and etc. More efficient nm-curves for trains and other vehicles can reduce energy consumption.

In the railroad system, the trains can be equipped with regenerative brakes, batteries, and other traction and energy transformation devices. A geometry of the route between stations (locations) is fixed. The geometry indicates the profile of the route, e.g., length, curves, and slope. The resistance from air and tracks are also considered to be a function of the velocity and location of the train along the route. The mass of the train is assumed to be constant, ignoring relatively small variations in the number of passengers and the amount of cargo.

Since travel time requirement is affected by not only the predetermined time-table but also the dynamic situation, the requirement can not be known until just before departure, particularly in high-density railway systems.

At the same time, loading and unloading time can vary dynamically from station to station, depending on time of day, and day of the week. Also, tracks along the route can be under repair during operation of the high-density railway system. All of these conditions lead to changing travel time requirements before the departure time for each trip.

Thus, it is important to optimize the run curves in a short time according to given travel time requirements that are subject to changes before departure.

Dynamics of the system can be described by $$\frac{dv}{dt} = a[z(t), v(t), u(t)], \tag{1}$$

$$\frac{dz}{dt} = v(t), \tag{2}$$

where z(t) represents the location of the vehicle at a time t, v(t) represents the velocity of the vehicle at time t, u(t) represents an action (acceleration, deceleration, braking, coasting, and etc.) taken by the vehicle at time t, and a(z(t), v(t), u(t)) are functions that denote acceleration under the current location of the vehicle, velocity, and action considering various physical factors, e.g., air resistance, track resistance, track slope, motor efficiency, brake efficiency, etc.

A rate of energy consumption E for a vehicle and route is $$E = \int_0^T p[z(t), v(t), u(t)]dt, \tag{3}$$

where T is the travel time.

A power consumption at time t with corresponding vehicle location, velocity, and depends on p(z(t), v(t), u(t)).

Run-curve optimization is a minimization problem with an objective function $$J=\mu E+(1-\mu)T \tag{4},$$

and the constraints in equations (1), (2), and (3), where a weight μ describes a relative importance of minimizing time vs. energy.

A number of methods for solving this optimization problem are known, such as dynamic programming, heuristic optimization, and nonlinear optimization. K. K. Wong et al (2004) designed heuristics based on nonlinear optimization techniques for solving train run curve optimization problem, where the major efforts are on find optimal coasting-points. Y. Ding et al (2011) also designed a method for computing good costing points using Genetic Algorithms. These heuristic methods can find good but not optimal run curves. At the same time, the computation time increases dramatically as the number of coasting points increases. H. Ko et al (2006) and L. Li et al (2011) developed dynamic programming based algorithm for calculating the optimal run curve for given travel time requirement. These two methods can find the optimal run curves. However, these two methods need large memory storage and long computation time. At the same time, the computational process can not benefit from previous computation. Thus, they are suitable for off-line computation but not able to quickly adapt to newly updated travel time requirement. Our invention can not only compute the optimal run-curve with smaller amount of memory, but also quickly recompute optimal run-curves for updated travel time requirement by re-using existing computation results.

[1] H. Ko, T. Koseki, and M. Miyatake. Numerical study on dynamic programming applied to optimization of running profile of a train. WIT Press, 103-112, 2004.

[2] L. Li, W. Dong, Y. Ji, and Z. Zhang. An Optimal driving strategy for high-speed electric train. In 2011 30th Chinese Control Conference, pages 5899-5904,2011. [3] Y. Ding, H. Liu, Y. Bai, and F. Zhou. A two-level optimization model and algorithm for energy-efficient urban train operation. Journal of Transportation Systems Engineering and Information Technology, 11(1):96-101,2011. [4] K. K. Wong and T. K. Ho. Coast control for mass rapid transit railways with searching methods. In IEE Proceedings on Electric Power Applications, 2004.

SUMMARY OF THE INVENTION

The embodiments of the invention provide a method for determining an optimal run-curve for a vehicle under a constraint of travel time T along a route between two locations while minimizing energy consumption.

In this case, a search for an appropriate weight μ can potentially require solving the optimization problem in equation (4) many times.

This is a significant bottleneck for obtaining a real-time solution, particularly when the weight μ, which minimizes time vs. energy, is near 1.

The purpose of the invention is to transfer the computation load as much as possible from real-time processing to off-line pre-processing by reusing a state transition matrix for an approximate dynamic programming procedure, and reducing the computational time required to determine the weights μ in real-time.

DESCRIPTION OF THE INVENTION

Figure 1:
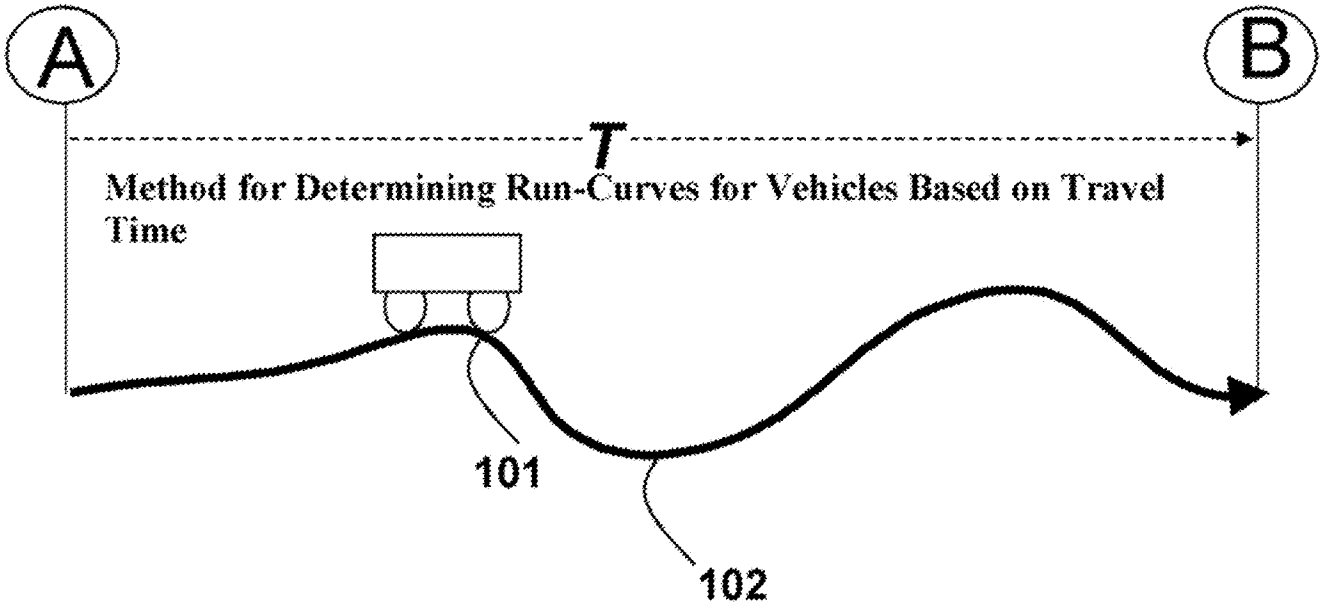
FIG. 1 is a schematic of a vehicle traveling along a route between to two locations according to embodiments of the invention.

As shown in FIG. 1, the embodiments of our invention provide a method for determining an optimal run-curve for a vehicle 101 traveling along a route 102 from a first location A to a second location B. The run-curve is constrained by a travel time T between the two locations.

The embodiments transfer most of the computation load to pre-processing. The method reduces the computational load for solving an optimization problem and a searching process for appropriate weights μ that minimize time vs. energy during real-time.

Figure 2:
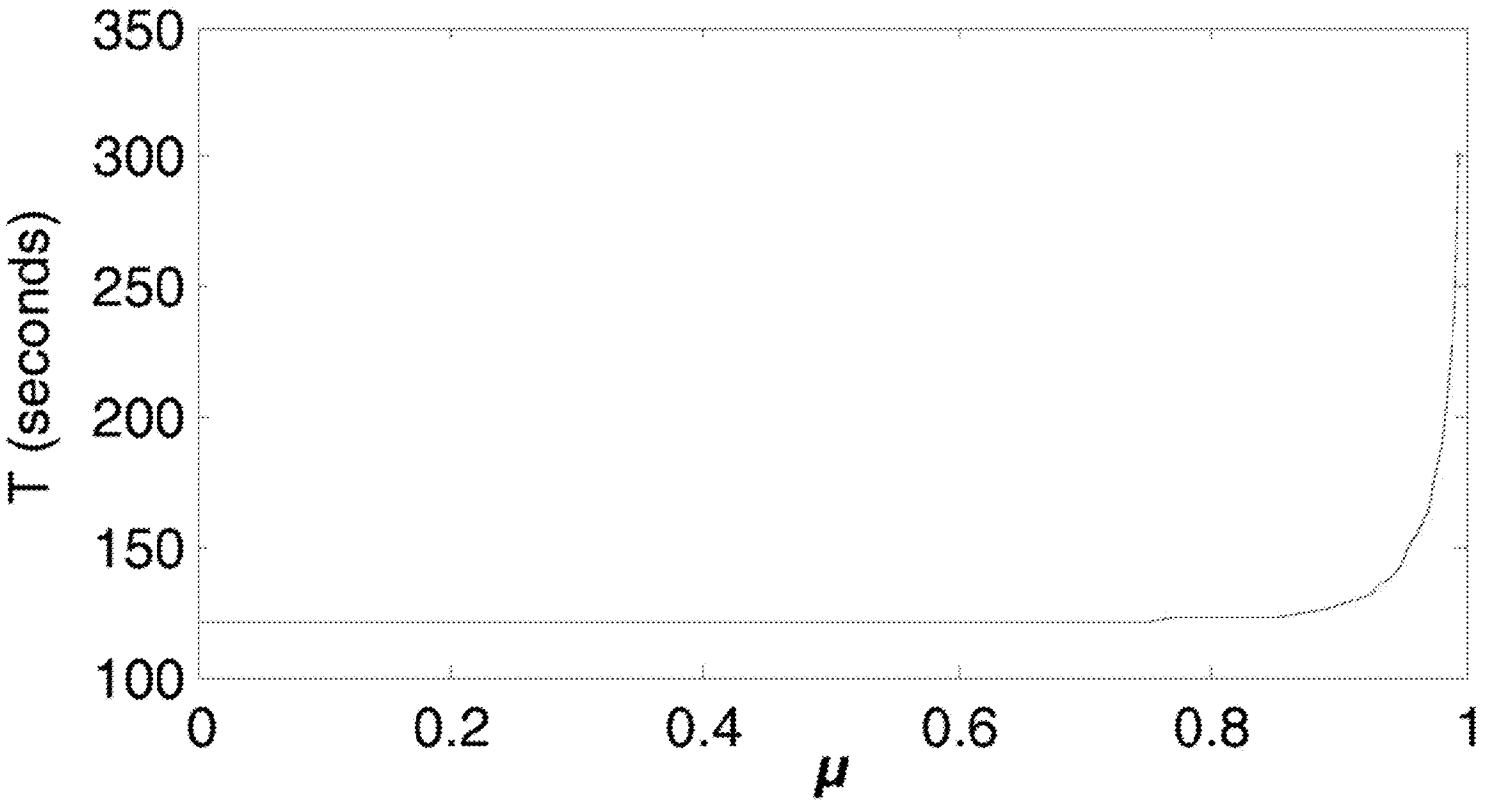
FIG. 2 is a graph of travel time as a function of weight, which minimizes time vs. energy, determined during pre-processing according to embodiments of the invention.

As shown in FIG. 2, we can fit a function of a relation between weights μ and travel times T, denoted as $T=f(\mu)$. We use this function to interpolate for unknown travel times, which only become available in real-time short time before vehicle departure.

Figure 3:
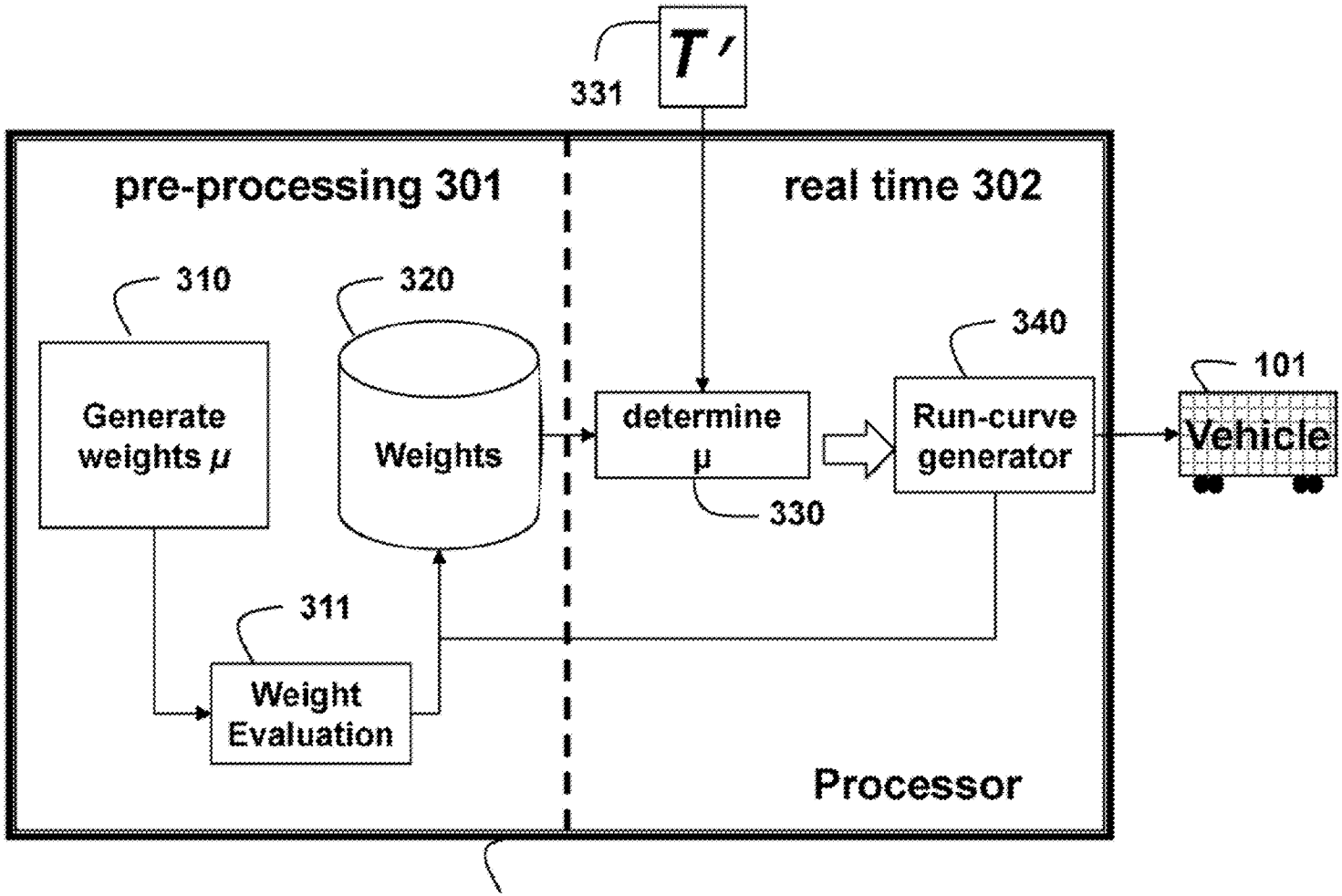
FIG. 3 is a flow diagram of a method determining an optimal run-curve for a vehicle under a constraint of travel time T according to embodiments of the invention.

FIG. 3 shows our method for generating 340 an optimal run-curve for the vehicle 101 traveling along the route 102. Our overall approach is to partition the computational process into off-line pre-processing 301, and real-time processing 301. The steps of the method can be performed in a processor 300 connected to memory and input/output interfaces as known in the art.

During pre-processing, a set of weights μ are generated 310 and evaluated 311 for run-curves and a corresponding set of travel times. The weights are stored in a memory 320, e.g., an indexed database. That is, given a specific travel time the corresponding weight can be readily determined. The pre-processing is only required once for each vehicle and route profile pair.

While generating the weights, reusable parts in the optimization problem are also stored in the memory. For example, a state transition matrix is stored when dynamic programming is used to solve the optimization problems for the different weights μ, see the related Application.

During real-time processing, when the vehicle is about to depart location A, a specific travel time T' 331 is received in real-time, e.g., from a dispatching entity.

The weight μ value is determined 330 by interpolating from the weights stored in the memory 320 using the travel time function $$\mu'=f^{-1}(T').$$

During off-line and real-time processing, the optimization problem minimizes the objective function (4) subject to the constraints in equations (1) and (2). This problem can be solved using, for example, an approximate dynamic programming method using equal distance discretization, see the related Application.

During real-time processing, the appropriate weight μ is either directly interpolated from the weights stored in the memory, or obtained by means of an additional searching process after interpolation. Each pair of μ and T' in the solution is treated as a candidate solution, and can be stored in the memory.

By generating a sufficient number of weights and updating the memory with the data obtained for new solutions, the weights stored in the memory increase in accuracy for the interpolation. The updating step is very beneficial for a smoothly operating transport system where there are a large number of vehicle departures along well know routes, and hourly and daily traffic patterns tend to repeat, and the repeating patterns is evident in the data that are stored in the memory. This application is particularly distinguished for conventional long-haul railroads, where departures for routes tend to much less frequent, and travel times tend to be available early, and not late, i.e., within seconds of departure as in subway systems.

By using this approach, the search effort for appropriate weights is reduced dramatically. Instead of many, only one simple optimization problem is required.

Effect of the Invention

The embodiments of the invention provide a method for determining an optimal run-curve for a vehicle under a constraint of travel time T along a route between two locations with the following advantages.

By transfer of the computation load to off-line pre-processing, a significant amount of time reduction is achieved during the real-time processing, when the desired travel time becomes available on short notice.

The stored state transition matrix saves about 40% of the computational time, when comparing with direct implementation of an approximate dynamic programming approach.

Additionally, by reducing the searching effort for appropriate weights μ, our method can reduce computational time further, from 15% to 73% and an average 49%, using a relatively small number (60) of weights obtained during the pre-processing.

If many weights are stored, then only one optimization problem needs to be solved, and the savings of computational time is nearly 80%.

The speed-up of optimal run-curve computation improves the vehicle's ability to quickly respond to changing travel time requirements just before departure. The advance warning can be a relatively small number of seconds before a vehicle, after unloading and loading passengers, is ready for departure, or can even vary dynamically after departure.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for determining an optimal run-curve for a vehicle under a constraint of travel time T along a route between two locations and controlling the vehicle to minimize consumption of energy, comprising off-line pre-processing and real-time processing, wherein the off-line preprocessing comprises the steps of:

generating a set of pairs of weights and corresponding travel times, wherein, for each weight and each travel time in each pair, the weight minimizes the energy consumed by the vehicle as a function of the travel time;

storing, the pairs of weights and the corresponding travel times in a memory; and wherein the real-time processing comprises the steps of:

receiving a specific travel time;

determining the weight for the specific travel time using the set of weights;

generating the run-curve for the vehicle based on the weight for the specific travel time, and operating the vehicle based on said run curve wherein the steps are performed in a processor.

2. The method of claim 1, further comprising:

storing, during the off-line pre-processing, a state transition matrix for each weight and travel time in the memory to enable an approximate dynamic programming method to be applied for the real-time steps.

3. The method of claim 1, wherein the weight for the specific travel time is obtained by interpolating the stored weights and travel times.

4. The method of claim 1, further comprising:

updating the memory with data obtained during the real-time processing.

5. The method of claim 1, wherein the specific travel time is received after departure of the vehicle.

6. The method of claim 1, wherein the off-line pre-processing steps are performed once for each vehicle and route profile.

7. The method of claim 1, wherein the vehicle is a train.

8. The method of claim 7, wherein the train is part of a subway system.

9. The method of claim 1, wherein the travel time T is a function $f(\mu)$, of the set of pairs of weights $\mu$.

10. The method of claim 1, wherein the interpolating is according to $\mu'=f^{-1}(T')$, wherein T', is the specific travel time, and $\mu'$ is the corresponding weight.

* * * * *